US010153619B2

(12) United States Patent
Uegaki et al.

(10) Patent No.: US 10,153,619 B2
(45) Date of Patent: Dec. 11, 2018

(54) SPARK PLUG

(71) Applicant: NGK SPARK PLUG CO., LTD., Nagoya-shi, Aichi (JP)

(72) Inventors: Hironori Uegaki, Nagoya (JP); Haruki Yoshida, Tajimi (JP); Hirokazu Kurono, Nagoya (JP)

(73) Assignee: NGK SPARK PLUG CO., LTD., Nagoya-shi, Aichi (JP)

( * ) Notice: Subject to any disclaimer, the term of this patent is extended or adjusted under 35 U.S.C. 154(b) by 0 days.

(21) Appl. No.: 15/736,492

(22) PCT Filed: Jun. 2, 2016

(86) PCT No.: PCT/JP2016/002667
§ 371 (c)(1),
(2) Date: Dec. 14, 2017

(87) PCT Pub. No.: WO2016/208129
PCT Pub. Date: Dec. 29, 2016

(65) Prior Publication Data

US 2018/0191138 A1 Jul. 5, 2018

(30) Foreign Application Priority Data

Jun. 22, 2015 (JP) ..... 2015-124316

(51) Int. Cl.
*H01T 13/34* (2006.01)
*H01T 13/20* (2006.01)

(52) U.S. Cl.
CPC ..... *H01T 13/34* (2013.01); *H01T 13/20* (2013.01)

(58) Field of Classification Search
None
See application file for complete search history.

(56) References Cited

U.S. PATENT DOCUMENTS 6,160,342 A * 12/2000 Nishikawa ..... H01T 13/41 313/136
6,831,395 B2 * 12/2004 Nishikawa ..... H01T 13/38 313/118
2013/0285534 A1 10/2013 Ochiai et al.
2013/0307402 A1 11/2013 Yoshida et al.

FOREIGN PATENT DOCUMENTS

JP 58-102480 A 6/1983
JP 09-050878 A 2/1997
WO WO 2012-105255 A1 8/2012

OTHER PUBLICATIONS

International Search Report from corresponding International Patent Application No. PCT/JP16/02667, dated Aug. 8, 2016.
Office Action received in corresponding Japanese Patent Application No. 2015-124316, dated Jul. 26, 2016.

* cited by examiner

*Primary Examiner* — Ashok Patel
(74) *Attorney, Agent, or Firm* — Kusner & Jaffe

(57) ABSTRACT

A spark plug having a center electrode that is formed by joining a conductive portion made of a conductive material and an insulating portion made of an insulating material. A sealing member electrically connects the conductive portion to a resistor. The insulating portion includes a protruding portion at a location on the back side of a back end of the sealing member. The protruding portion is embedded in the resistor.

6 Claims, 7 Drawing Sheets

SPARK PLUG

RELATED APPLICATIONS

This application is a National Stage of International Application No. PCT/JP16/02667 filed Jun. 2, 2016, which claims the benefit of Japanese Patent Application No. 2015-124316, filed Jun. 22, 2015, the entire contents of which are incorporated herein by reference.

FIELD OF THE INVENTION

The present invention relates to a spark plug.

BACKGROUND OF THE INVENTION

Spark plugs are used to cause a spark discharge for igniting air-fuel mixture in a combustion chamber. An example of a spark plug having a known structure includes an insulator having an axial hole that extends through the insulator along an axis; a metal shell that holds the insulator therein; a center electrode held in the axial hole; and a conductive sealing member that holds the center electrode in the axial hole (International Publication No. 2012/105255). In the structure disclosed in International Publication No. 2012/105255, the center electrode includes a flange portion that protrudes in a radial direction, and a head portion that projects from the flange portion toward a back side. This structure enables the center electrode to be held in the insulator. More specifically, the flange portion abuts against a step portion provided in the axial hole so that the center electrode does not move toward a front side. In addition, a sealing member is provided around the head portion and the flange portion so that the center electrode has sufficient shock resistance and the center electrode does not become loose when the center electrode receives the impact of combustion.

The spark plug is required to include electrodes having sufficient durability against repeated spark discharge. The durability can be effectively increased by reducing the capacitance between the metal shell and a conductor disposed in the insulator. Here, the conductor is the sealing member or the center electrode. The capacitance can be reduced by, for example, reducing the length of the head portion and reducing the height of the sealing member in the axial direction by an amount corresponding to the reduction in the length of the head portion. However, when the length of the head portion is reduced, the retaining force of the sealing member is also reduced. Accordingly, the shock resistance of the center electrode is reduced and the center electrode easily becomes loose. In light of the above-described circumstances, an advantage of the present invention is to reduce the capacitance and ensure that the center electrode has sufficient shock resistance at the same time.

The present invention achieves the above-described advantage, and is realized in the following forms.

SUMMARY OF THE INVENTION (1) According to an aspect of the present invention, a spark plug includes a metal shell that has a substantially tubular shape and that is provided with a ground electrode at a front side of the metal shell; an insulator that has a tubular shape and that is held in the metal shell, the insulator having an axial hole provided therein, the axial hole including a small-diameter portion and a large-diameter portion that has a diameter greater than a diameter of the small-diameter portion and that is connected to a back end of the small-diameter portion with a step portion provided therebetween; a resistor disposed in the large-diameter portion; a center electrode including a flange portion that protrudes in a radial direction in the large-diameter portion and that is in contact with the step portion, a leg portion that extends toward the front side from the flange portion and that is disposed in the small-diameter portion, and a head portion that extends toward a back side from the flange portion; and a conductive sealing member that is disposed in the large-diameter portion and that electrically connects the center electrode to the resistor. The center electrode is formed by joining a conductive portion made of a conductive material and an insulating portion made of an insulating material. The sealing member electrically connects the conductive portion to the resistor. The insulating portion includes a protruding portion at a location on the back side of a back end of the sealing member. The protruding portion is embedded in the resistor. According to this aspect, even when the length of the sealing member in the axial direction is reduced to reduce the capacitance, the center electrode has sufficient shock resistance because the protruding portion is embedded in the resistor. In addition, part of the protruding portion that is formed of the insulating portion does not increase the capacitance. Thus, the capacitance can be reduced and sufficient shock resistance of the center electrode can be ensured at the same time. Moreover, since part of the protruding portion that is formed of the insulating portion reliably adheres to the resistor, the shock resistance of the center electrode is increased.

(2) In accordance with a second aspect of the present invention, there is provided a spark plug, as described above, wherein the conductive portion may be separated from the resistor by the insulating portion and the sealing member. In this case, the conductive material, whose wettability is lower than that of the insulating material, is separated from the resistor. Therefore, the center electrode reliably adheres to the resistor, and the shock resistance can be increased.

(3) In accordance with a third aspect of the present invention, there is provided a spark plug, as described above, wherein the conductive portion may include a recess that is recessed toward the front side in a back end portion of the conductive portion; the insulating portion may include a projection that projects toward the front side on a front end portion of the insulating portion; and the projection may be fitted in the recess. In this case, the conductive material and the insulating material can be easily joined together, and the capacitance can be prevented from being increased due to the joining shape.

(4) In accordance with a fourth aspect of the present invention, there is a provided a spark plug, as described above, wherein the conductive portion may include a projection that projects toward the back side on a back end portion of the conductive portion; the insulating portion may include a recess that is recessed toward the back side in a front end portion of the insulating portion; and the projection may be fitted in the recess. In this case, the conductive material and the insulating material can be easily joined together.

(5) In accordance with a fifth aspect of the present invention, there is provided a spark plug, as described above, wherein, a coefficient of thermal expansion of the insulating material may be between a coefficient of thermal expansion of the conductive material and a coefficient of thermal expansion of the resistor. To reduce the occurrence of cracks in manufacture or in use, the coefficient of thermal expansion of the insulating material preferably does not differ from the coefficient of thermal expansion of the conductive material or the coefficient of thermal expansion of the resistor by a large amount. In the above-described case, the difference in coefficient of thermal expansion can be reduced.

The present invention can be realized in various forms other than that described above. For example, the present invention can be realized in the form of a method for manufacturing a spark plug.

DESCRIPTION OF THE INVENTION

Figure 1:
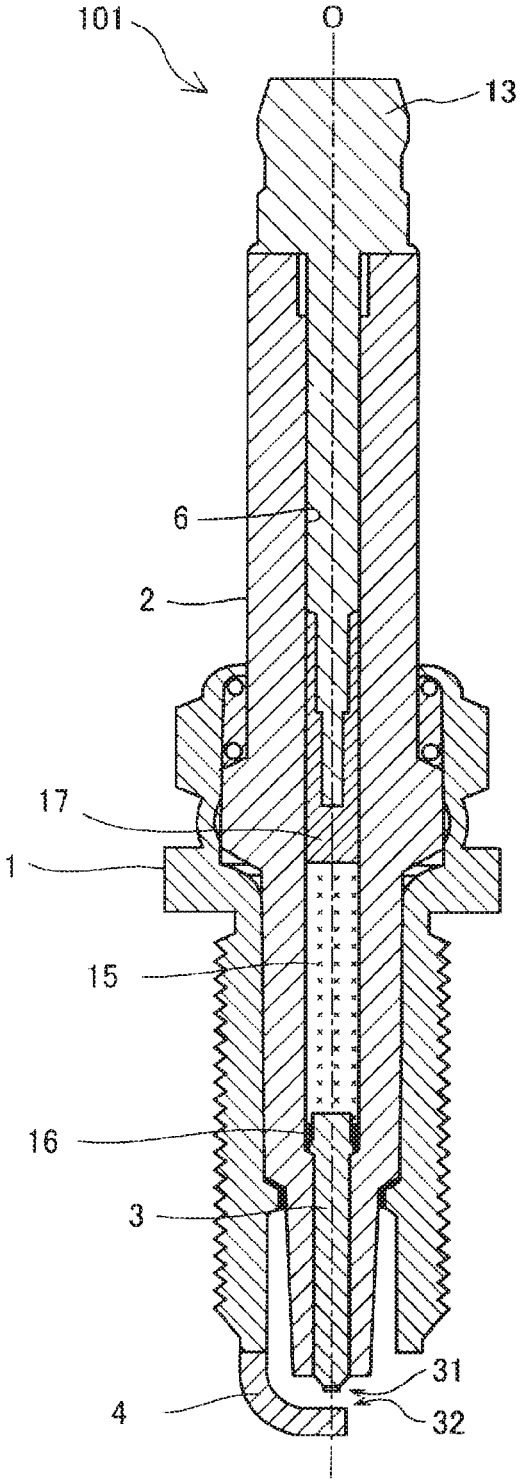
FIG. 1 is a sectional view of a spark plug

A first embodiment will now be described. FIG. 1 is a sectional view of a spark plug 101. The spark plug 101 includes a metal shell 1, an insulator 2, a center electrode 3, a ground electrode 4, and a terminal 13. In FIG. 1, the axis O is the center of the spark plug 101 in the longitudinal direction. The ground-electrode-4 side of the spark plug 101 along the axis O is referred to as the front side, and the terminal-13 side of the spark plug 101 is referred to as the back side.

The metal shell 1 is made of a metal, such as carbon steel, and has a hollow cylindrical shape. The metal shell 1 constitutes a housing of the spark plug 101. The insulator 2 is made of a ceramic sintered by, and a front portion thereof is disposed in the metal shell 1. The insulator 2 is a tubular member, and an axial hole 6 that extends along the axis O is formed in the insulator 2. A portion of the terminal 13 is inserted in and fixed to one end portion of the axial hole 6, and the center electrode 3 is inserted in and fixed to the other end portion of the axial hole 6. A resistor 15 is disposed between the terminal 13 and the center electrode 3 in the axial hole 6. One end portion of the resistor 15 is electrically connected to the center electrode 3 with a conductive glass scaling layer 16 interposed therebetween, and the other end portion of the resistor 15 is electrically connected to the terminal 13 with a terminal-side conductive glass sealing layer 17 interposed therebetween.

The resistor 15 functions as an electric resistance between the terminal 13 and the center electrode 3, thereby reducing the occurrence of radio noise (or simply noise) during spark discharge. The resistor 15 is made of ceramic powder, a conductive material, glass, and a binder (adhesive). In the present embodiment, the resistor 15 is manufactured in accordance with a manufacturing procedure described below.

The center electrode 3 includes a firing end 31 at the front end thereof, and is disposed in the axial hole 6 in such a manner that the firing end 31 is exposed. One end of the ground electrode 4 is welded to the metal shell 1. The other end of the ground electrode 4 is bent sideways, and a front end portion 32 of the ground electrode 4 is arranged so as to face the firing end 31 of the center electrode 3 with a gap therebetween.

The metal shell 1 of the spark plug 101 having the above-described structure has a threaded portion on the outer peripheral surface thereof. The spark plug 101 is attached to a cylinder head of an engine by using the threaded portion.

Figure 2:
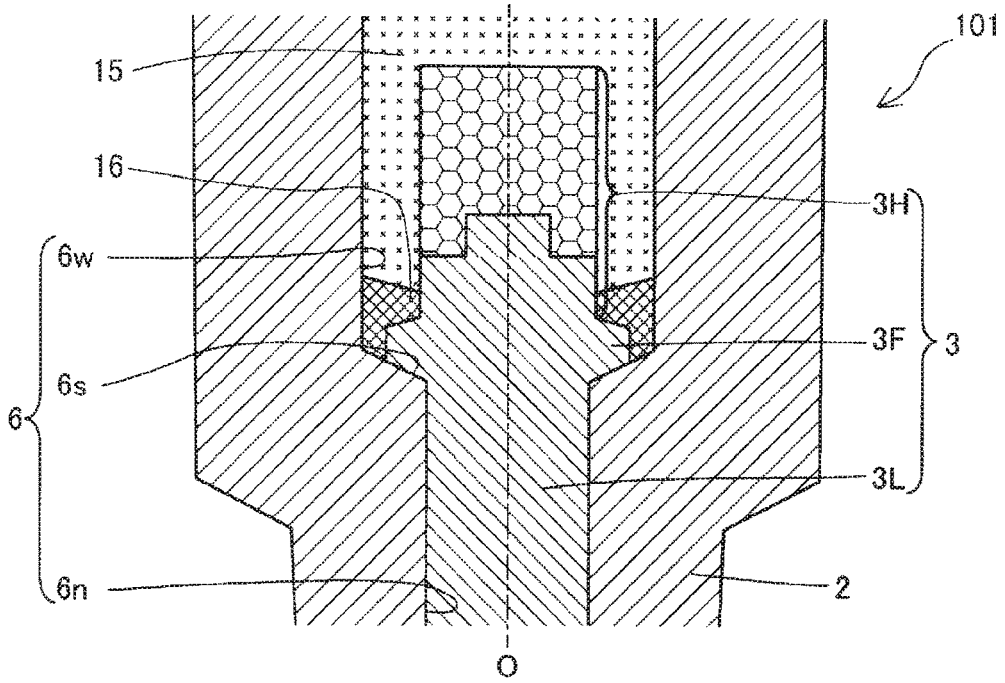
FIG. 2 is an enlarged sectional view of a section around a conductive glass sealing layer.

FIG. 2 is an enlarged sectional view of a section around the conductive glass sealing layer 16. The axial hole 6 includes a large-diameter portion 6*w* and a small-diameter portion 6*n*. The large-diameter portion 6*w* has an inner diameter greater than that of the small-diameter portion 6*n*. The large-diameter portion 6*w* includes a step portion 6*s*, and the step portion 6*s* is connected to the back end of the small-diameter portion 6*n*.

The center electrode 3 includes a flange portion 3F, a leg portion 3L, and a head portion 3H. The flange portion 3F protrudes in the radial direction in the large-diameter portion 6*w* and is abutted against the step portion 6*s*. The leg portion 3L extends from the flange portion 3F toward the front side, and is disposed in the small-diameter portion 6*n*. The head portion 3H extends from the flange portion 3F toward the back side.

Figure 3:
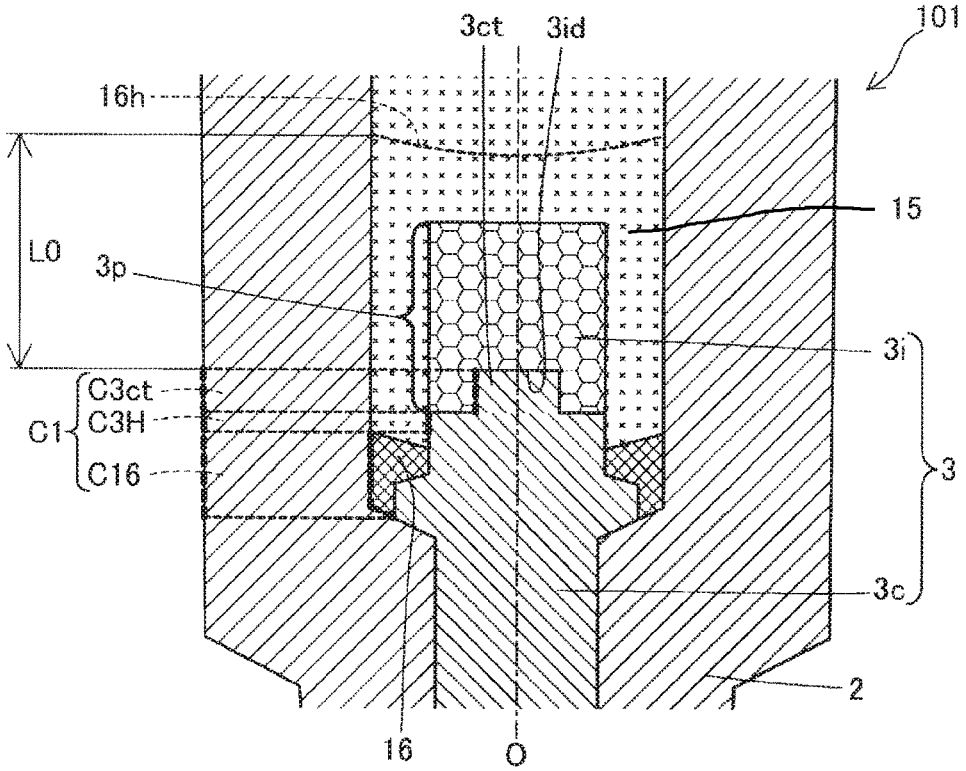
FIG. 3 is an enlarged sectional view of the section around the conductive glass sealing layer.

FIG. 3 is an enlarged sectional view of the section around the conductive glass sealing layer 16. The center electrode 3 is formed by combining an insulating portion 3*i* and a conductive portion 3*c*. The insulating portion 3*i* is located on the back side of the conductive portion 3*c*.

The conductive portion 3*c* is made of a metal material, such as a nickel alloy or a copper alloy. The insulating portion 3*i* is made of an insulating material. More specifically, the insulating portion 3*i* is made of, for example, aluminum nitride (AlN), silicon nitride (SiN), or mullite ($3Al_2O_3.2SiO_2$ to $2Al_2O_3.SiO_2$).

The coefficient of thermal expansion of the insulating material of the insulating portion 3*i* is between the coefficient of thermal expansion of the conductive material of the conductive portion 3*c* and the coefficient of thermal expansion of the resistor 15. In the present embodiment, the coefficient of thermal expansion of the conductive material is $12\times10^{6}$/° C., and the coefficient of thermal expansion of the resistor 15 is $5.7\times10^{-6}$/° C. Therefore, the coefficient of thermal expansion of the insulating material is any value that is greater than $5.7\times10^{6}$/° C. and less than $12\times10^{-6}$/° C.

The coefficient of thermal expansion of the resistor 15 can be measured by removing only the resistor 15 from the spark plug 101. The measurement of the coefficient of thermal expansion is performed by, for example, thermo-mechanical analysis (TMA).

The insulating portion 3*i* includes a recess 3*id*. The recess 3*id* is formed in the front end surface of the insulating portion 3*i* so as to be recessed toward the back side. The conductive portion 3*c* includes a projection 3*ct*. The projection 3*ct* is formed on the back end surface of the conductive portion 3*c* so as to project toward the back side. The insulating portion 3*i* and the conductive portion 3*c* are joined together by fitting the projection 3*ct* to the recess 3*id*.

The insulating portion 3*i* includes a protruding portion 3*p*. The protruding portion 3*p* is a portion that protrudes toward the back side beyond the back end of the conductive glass sealing layer 16. In the present embodiment, the entirety of the insulating portion 3*i* constitutes part of the protruding portion 3*p*. The protruding portion 3*p* is embedded in the resistor 15. The insulating portion 3*i* is made of an insulating material, and therefore has a high wettability. Accordingly, part of the head portion 3H that is formed of the insulating portion 3*i* reliably adheres to the resistor 15.

The leg portion 3L is formed of the conductive portion 3*c*. In the present embodiment, the head portion 3H is formed of the insulating portion 3*i* and the conductive portion 3*c*, and the flange portion 3F is formed of the conductive portion 3*c*.

The capacitance of a capacitor formed in the range from the front end of the conductive glass sealing layer 16 to the back end of the resistor 15 will now be described. The capacitor is formed between the metal shell 1 and a conductor (hereafter referred to as an inner conductor) disposed in the axial hole 6. The inner conductor according to the present embodiment includes the conductive glass sealing layer 16 and the conductive portion 3*c*. In the following description, the capacitance is denoted by C with a number indicating an embodiment (1 to 7) attached. For example, in the first embodiment, the capacitance is denoted by C1.

The capacitance C1 can be calculated as C1=C3*ct*+C3H+C16. The capacitance C3*ct* is the capacitance of a capacitor in which the inner conductor is the projection 3*ct* and the dielectric is the insulator 2, the resistor 15, and the insulating portion 3*i*. The capacitance C3H is the capacitance of a capacitor in which the inner conductor is the head portion 3H and the dielectric is the insulator 2 and the resistor 15. The capacitance C16 is the capacitance of a capacitor in which the inner conductor is the conductive glass sealing layer 16 and the dielectric is the insulator 2. Since the capacitances C3*ct*. C3H, and C16 are connected in parallel, the sum thereof is equal to the above-described capacitance C1.

In general, the capacitance C of a coaxial cylindrical capacitor is calculated as $C=2\pi\varepsilon L/\log(b/a)$. Here, L is the length of the cylinder in the axial direction (hereinafter, the term "length" means a length in the direction of the axis O, and the term "short" means that the length in the direction of the axis O is short), E is the relative dielectric constant, a is the inner diameter of the cylinder, and b is the outer diameter of the cylinder. Accordingly, the capacitance C decreases as the length L decreases, and as the inner diameter a decreases if the outer diameter b is constant.

The imaginary line 16*h* in FIG. 3 shows the back end of a conductive glass sealing layer 16 according to a comparative example. The capacitance C1 is smaller than the capacitance in the comparative example since the length is smaller than that in the comparative example by L0. Here, L0 is the length from the back end of the projection 3*ct* to the back end of the conductive glass sealing layer 16 according to the comparative example.

As illustrated in FIG. 3, the outer diameter of the head portion 3H is smaller than that of the conductive glass sealing layer 16. Therefore, the capacitance C3H is lower than that of the capacitor including the conductive glass sealing layer 16 because the value corresponding to the inner diameter a is smaller. For a similar reason, the capacitance C3*ct* is lower than that of the capacitor including the conductive glass sealing layer 16. As a result, the capacitance C1 is lower than that in the case where the entirety of the inner conductor is formed of the conductive glass sealing layer 16.

Even though the capacitance C1 is reduced by reducing the length of the conductive glass sealing layer 16 as described above, the center electrode 3 has sufficient durability. The reason why the center electrode 3 has sufficient durability is that the head portion 3H, which is longer than the conductive glass sealing layer 16, is embedded in the resistor 15 and the conductive glass sealing layer 16.

Figure 4:
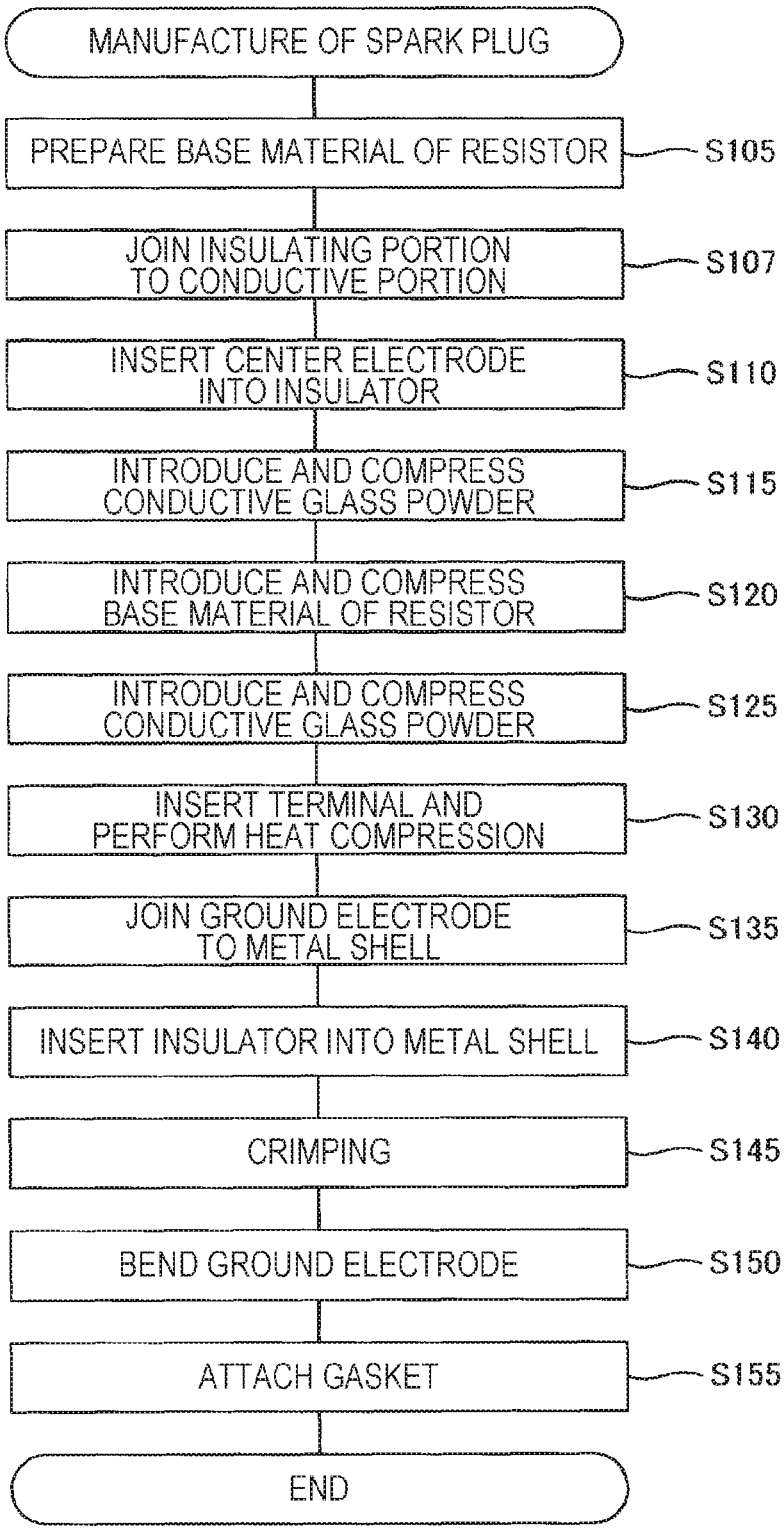
FIG. 4 is a flowchart of a manufacturing procedure of the spark plug.

FIG. 4 is a flowchart of a manufacturing procedure of the spark plug 101. First, the base material of the resistor 15 is manufactured (S105).

Figure 5:
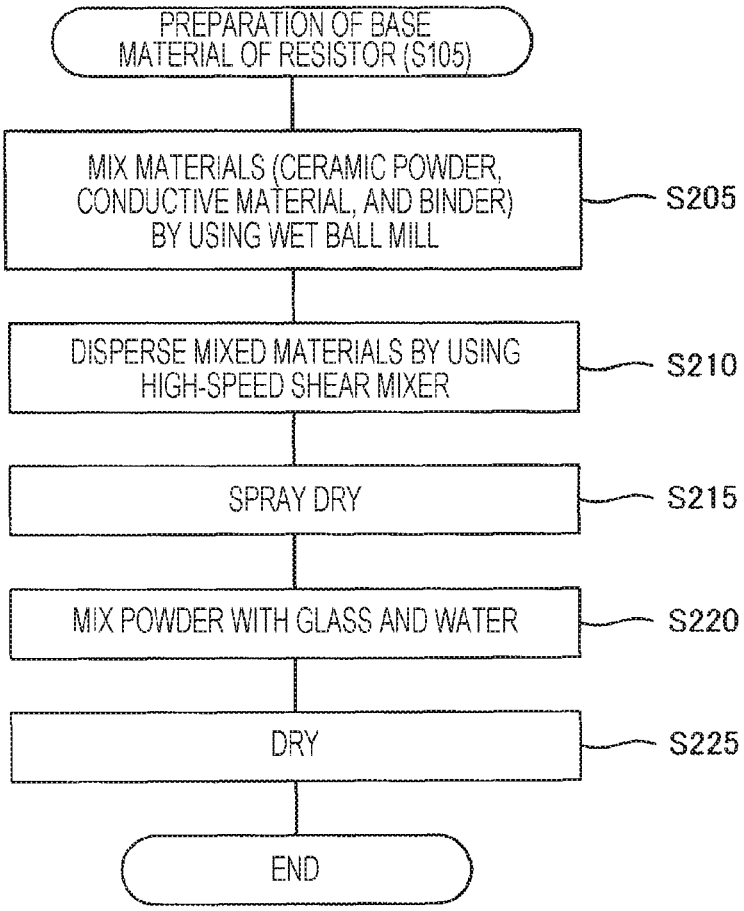
FIG. 5 is a flowchart of a manufacturing procedure of a base material of a resistor.

FIG. 5 is a flowchart of a manufacturing procedure of the base material of the resistor 15. First, materials are mixed by using a wet ball mill (S205). The materials include ceramic powder, a conductive material, and a binder. The ceramic powder contains, for example, $ZrO_2$ and $TiO_2$. The conductive material is, for example, carbon black. The binder (organic binder) is, for example, a dispersing agent composed of polycarboxylic acid or the like. These materials and water, which serves as solvent, are stirred and mixed by using a wet ball mill. Although the materials are mixed, the degree of dispersion of each material is relatively low.

Next, the mixed materials are dispersed by using a high-speed shear mixer (S210). The high-speed shear mixer is a mixer that mixes materials while dispersing the materials by using a large shear force generated by blades (mixing blades). The high-speed shear mixer is, for example, an axial mixer.

The material obtained in S210 is immediately granulated by a spray dry method (S215). The powder obtained in S215 is mixed with glass (coarse glass powder) and water (S220), and then the mixture is dried (S225). Thus, the base material of the resistor 15 (powder) is completed. A universal mixer, for example, may be used in S220.

Next, referring to FIG. 4, the insulating portion 3*i* and the conductive portion 3*c* are joined together (S107) by press-fitting the projection 3*ct* into the recess 3*id*. As a result of S107, the insulating portion 3*i* and the conductive portion 3*c* are joined together.

Next, the center electrode 3 is inserted into the axial hole 6 in the insulator 2 (S110). Then, conductive glass powder is introduced into the axial hole 6 and compressed (S115). The conductive glass powder is compressed by, for example, inserting a rod-shaped jig into the axial hole 6 and pressing the accumulated conductive glass powder. The jig has a recess in a compressing surface thereof so that the jig does not interfere with the head portion 3H. The inner diameter of the recess is greater than the outer diameter of the head portion 3H, and the depth of the recess is greater than the length of the head portion 3H. The layer of the conductive glass powder formed in S115 is formed into the conductive glass sealing layer 16 as a result of a heat compression step described below. The conductive glass powder is, for example, a mixture of copper powder and calcium borosilicate glass powder.

Next, the base material of the resistor 15 (powder) is introduced into the axial hole 6 and compressed (S120), and then conductive glass powder is introduced into the axial hole 6 and compressed (S125). The powder layer formed in S120 is formed into the resistor 15 as a result of the heat compression step described below. Similarly, the powder layer formed in S125 is formed into the terminal-side conductive glass sealing layer 17 as a result of the heat compression step described below. The conductive glass powder used in S125 is the same as the conductive glass powder used in S115. The compression method used in S120 and S125 is the same as the compression method used in S115. The jig used in S120 and S125 does not have a recess because the jig does not interfere with the head portion 3H.

Next, a portion of the terminal 13 is inserted into the axial hole 6, and a predetermined pressure is applied from the terminal-13 side while the entirety of the insulator 2 is heated (S130). As a result of this heat compression step, the materials that fill the axial hole 6 are compressed and fired, so that the conductive glass sealing layer 16, the terminal-side conductive glass sealing layer 17, and the resistor 15 are formed in the axial hole 6.

As described above, the coefficient of thermal expansion of the insulating portion 3*i* is between the coefficient of thermal expansion of the conductive portion 3*c* and the coefficient of thermal expansion of the resistor 15. Therefore, the occurrence of cracks in S130 is reduced.

Next, the ground electrode is joined to the metal shell 1 (S135), and the insulator 2 is inserted into the metal shell 1 (S140). Then, the metal shell 1 is crimped (S145). As a result of the crimping step in S145, the insulator 2 is fixed to the metal shell 1. Next, the front end of the ground electrode joined to the metal shell 1 is bent (S150). Thus, the ground electrode 4 is completed. After that, a gasket (not shown) is attached to the metal shell 1 (S155), and the spark plug 101 is completed.

Figure 6:
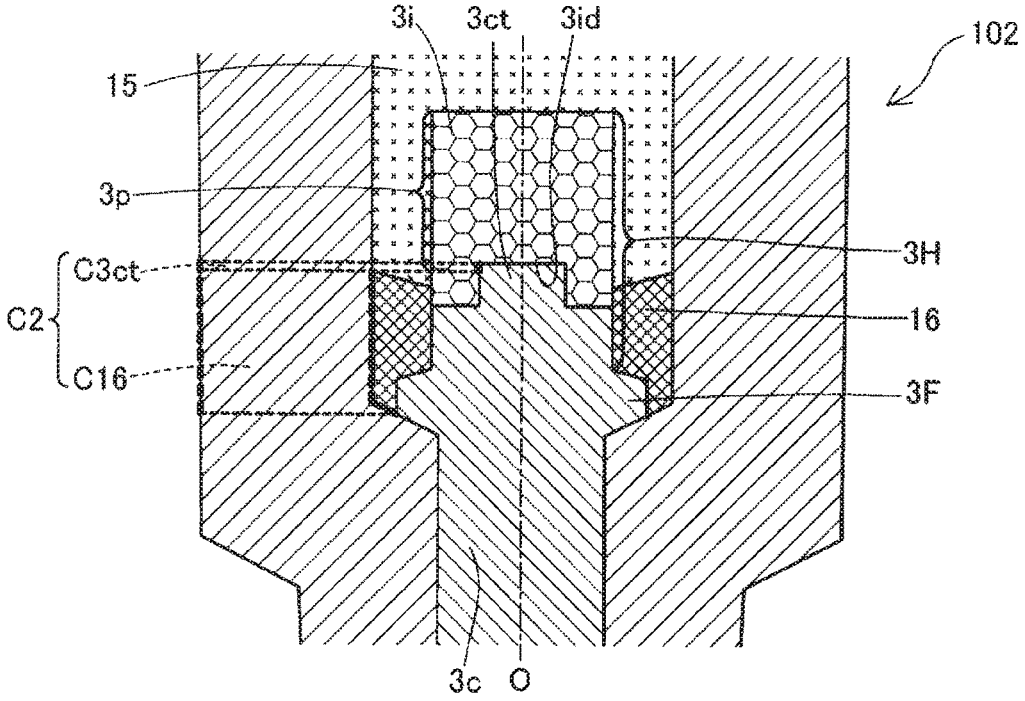
FIG. 6 is an enlarged sectional view of a section around a conductive glass sealing layer (second embodiment).

A spark plug 102 according to a second embodiment will be described with reference to FIG. 6. The second embodiment and third to seventh embodiments described below are similar to the first embodiment except for the points described in each embodiment.

In the spark plug 102, the protruding portion 3*p* is part of the insulating portion 3*i*. In addition, part of the insulating portion 3*i* is embedded in the conductive glass sealing layer 16. Thus, the conductive portion 3*c* is separated from the resistor 15 by the insulating portion 3*i* and the conductive glass sealing layer 16. Therefore, the insulating portion 3*i* is the only part of the head portion 3H that is in contact with the resistor 15. Hereinafter, the arrangement in which the insulating portion 3*i* is the only part of the head portion 3H that adheres to the resistor 15 is referred to as "adhesion only by the insulating portion 3*i*". The adhesion only by the insulating portion 3*i* also applies to the third to seventh embodiments.

When the adhesion only by the insulating portion 3*i* is employed, the adhesion between the center electrode 3 and the resistor 15 is improved, and the shock resistance is increased. This is because the wettability of the insulating portion 3*i* is higher than that of the conductive portion 3*c*.

The capacitance C2 of the spark plug 102 can be calculated as C2=C3*ct*+C16. Unlike the first embodiment, since the adhesion only by the insulating portion 3*i* is employed, there is naturally no capacitor that has the capacitance C3H.

Figure 7:
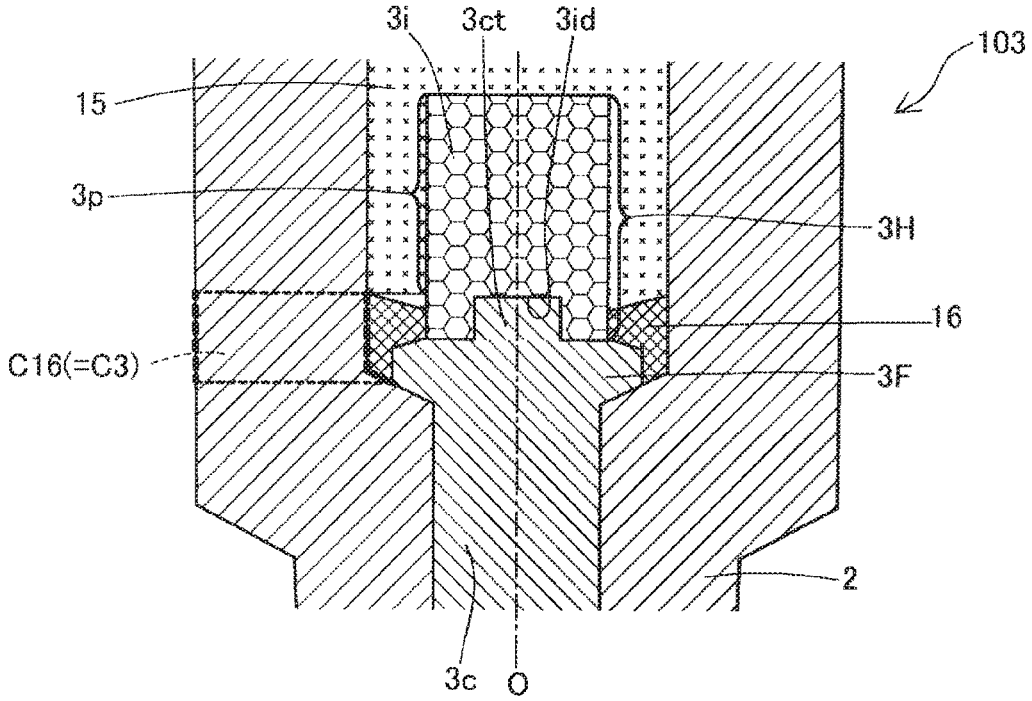
FIG. 7 is an enlarged sectional view of a section around a conductive glass sealing layer (third embodiment).

A spark plug 103 according to the third embodiment will be described with reference to FIG. 7. In the spark plug 103, the entire surface of the head portion 3H is formed of the insulating portion 3*i*. Therefore, the adhesion only by the insulating portion 3*i* can be achieved even when the length of the conductive glass sealing layer 16 is reduced to reduce the capacitance C16.

In the spark plug 103, the back end of the projection 3*ct* is located on the front side of the back end of the conductive glass sealing layer 16. Therefore, there is no capacitor that has the capacitance C3*ct*. Accordingly, the capacitance C3 is equal to the capacitance C16.

Figure 8:
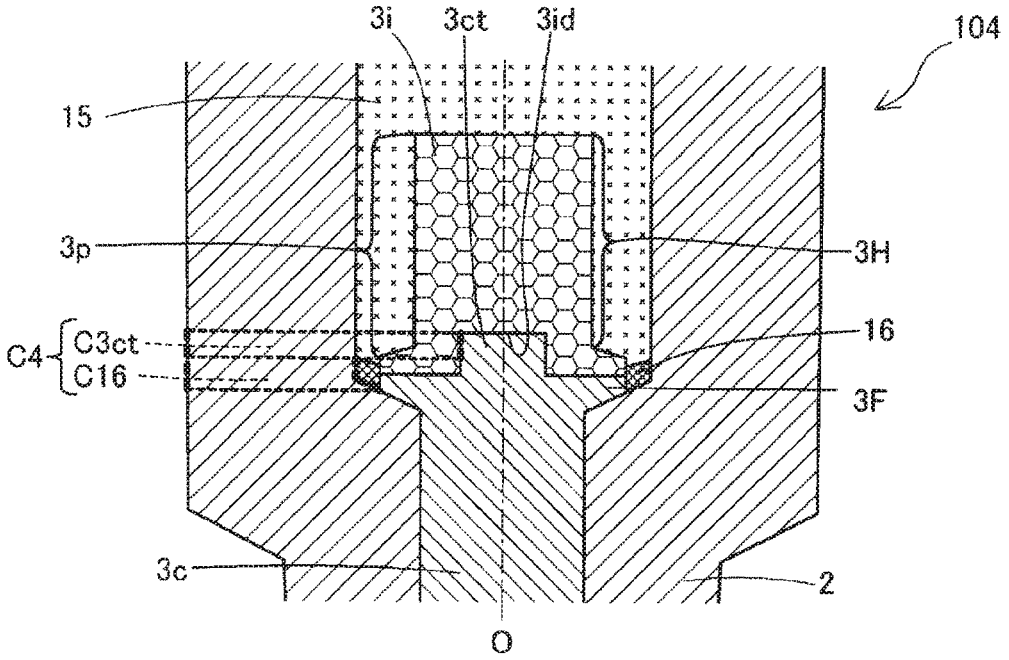
FIG. 8 is an enlarged sectional view of a section around a conductive glass sealing layer (fourth embodiment).

A spark plug 104 according to the fourth embodiment will be described with reference to FIG. 8. In the spark plug 104, the entirety of the head portion 3H and part of the flange portion 3F are formed of the insulating portion 3*i*. Accordingly, the flange portion 3F is formed of the conductive portion 3*c* and the insulating portion 3*i*.

Since part of the flange portion 3F is formed of the insulating portion 3*i* as described above, the length of the conductive glass sealing layer 16 can be made shorter than that in the spark plug 103. In addition, the adhesion between the resistor 15 and the insulating portion 3*i* is provided also at a portion of the flange portion 3F. Therefore, the adhesion between the resistor 15 and the center electrode 3 is further improved.

Figure 9:
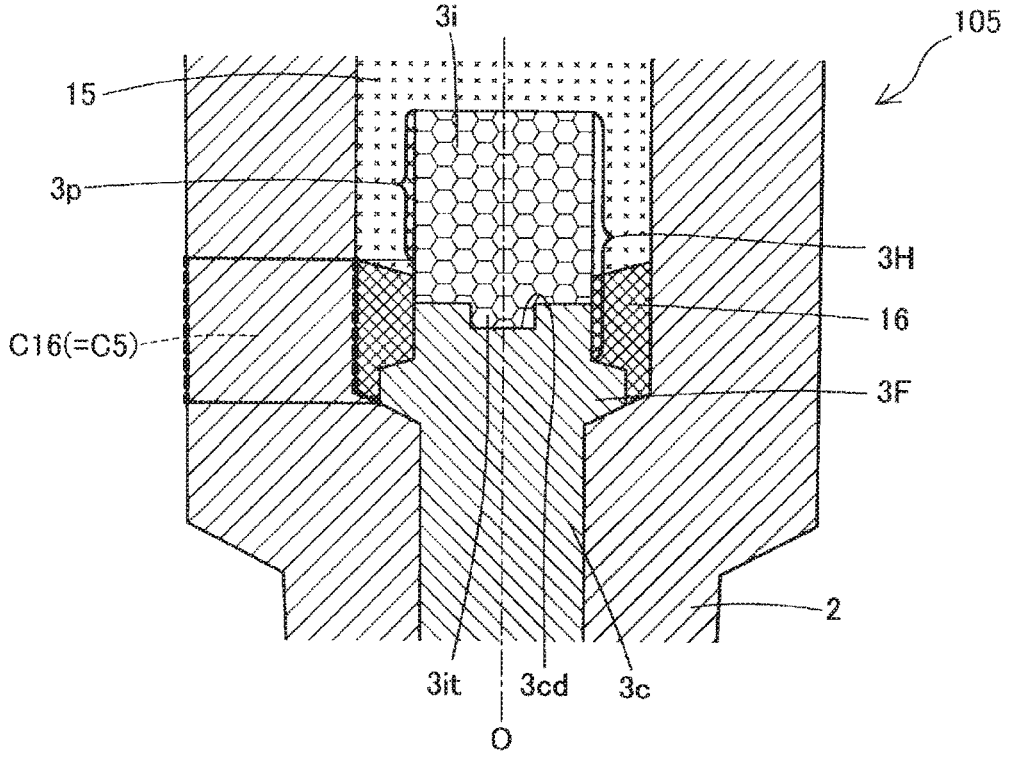
FIG. 9 is an enlarged sectional view of a section around a conductive glass sealing layer (fifth embodiment).

A spark plug 105 according to the fifth embodiment will be described with reference to FIG. 9. In the spark plug 105, the head portion 3H is formed of the insulating portion 3*i* and the conductive portion 3*c*, and the flange portion 3F is formed of the conductive portion 3*c*.

In the spark plug 105, the conductive portion 3*c* has a recess 3*cd*, and the insulating portion 3*i* has a projection 3*it*. The center electrode 3 is formed by press-fitting the projection 3*it* into the recess 3*cd*. The description regarding the recess 3*cd* and the projection 3*it* also applies to the sixth and seventh embodiments.

In the structure including the recess 3*cd* and the projection 3*it* as described above, there is naturally no capacitor including the projection 3*it* as the inner conductor. In addition, since the adhesion only by the insulating portion 3*i* is employed, there is no capacitance C3*c*. Therefore, the capacitance C5 is equal to the capacitance C16. Accordingly, an increase in the length of the projection 3*it* for increasing the joining force between the insulating portion 3*i* and the conductive portion 3*c* and prevention of an increase in the capacitance C5 can be easily achieved at the same time.

Figure 10:
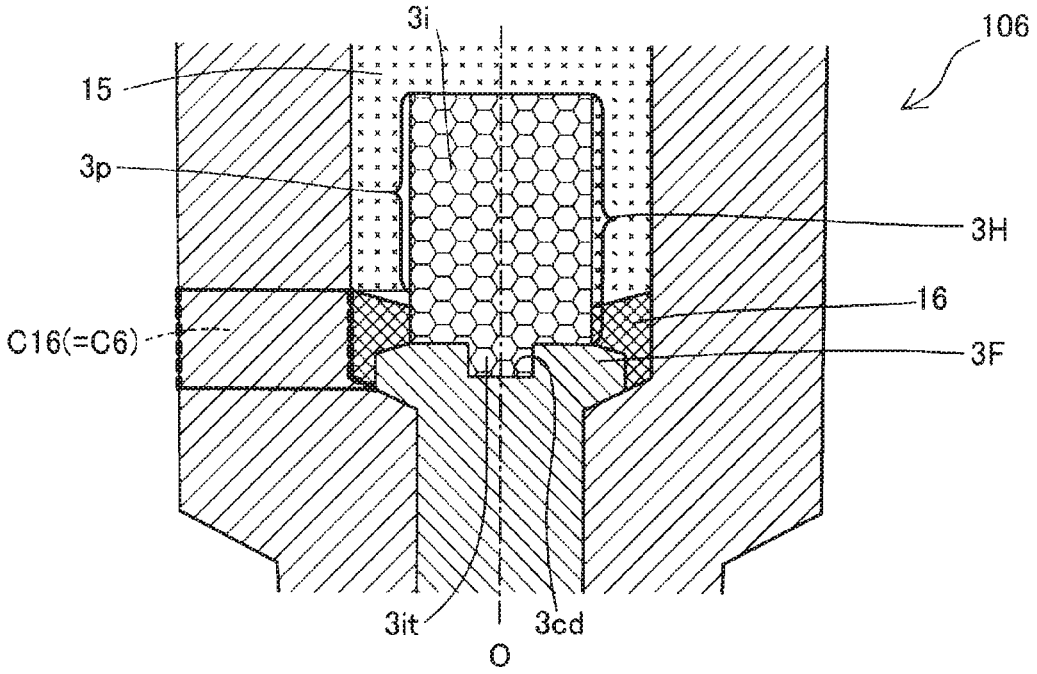
FIG. 10 is an enlarged sectional view of a section around a conductive glass sealing layer (sixth embodiment).

A spark plug 106 according to the sixth embodiment will be described with reference to FIG. 10. In the spark plug 106, similar to the spark plug 103 (FIG. 7), the head portion 3H is formed of the insulating portion 3*i*, and the flange portion 3F is formed of the conductive portion 3*c*.

According to the spark plug 106, similar to the spark plug 103, the adhesion only by the insulating portion 3*i* can be achieved even when the length of the conductive glass sealing layer 16 is reduced to reduce the capacitance C16. In addition, according to the spark plug 106, similar to the fifth embodiment, an increase in the joining force between the insulating portion 3*i* and the conductive portion 3*c* and prevention of an increase in the capacitance C6 can be easily achieved at the same time.

Figure 11:
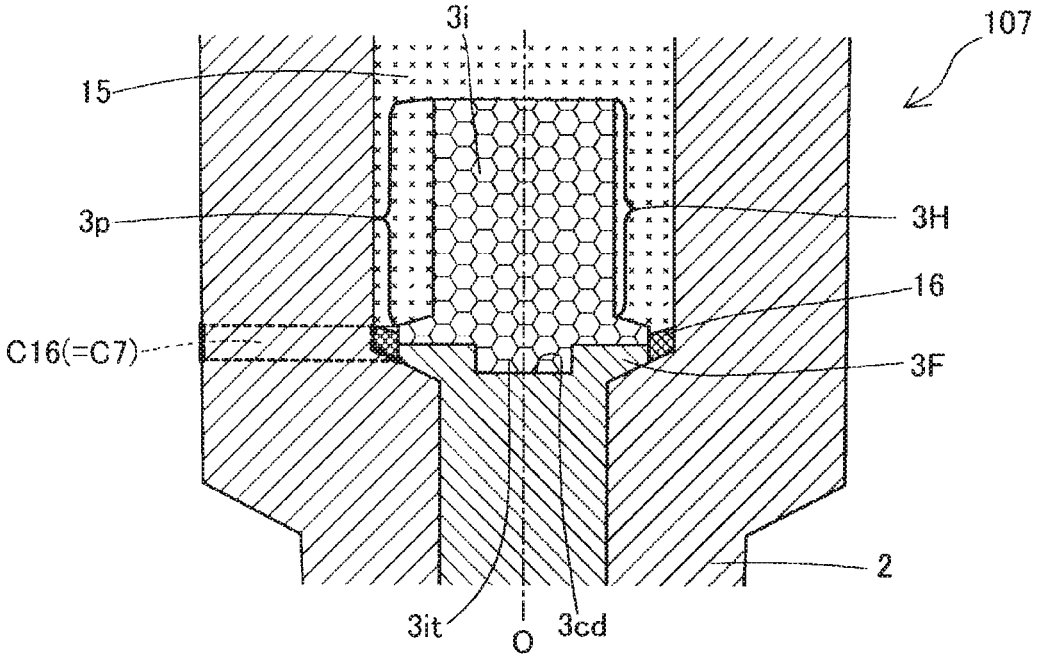
FIG. 11 is an enlarged sectional view of a section around a conductive glass sealing layer (seventh embodiment).

A spark plug 107 according to the seventh embodiment will be described with reference to FIG. 11. In the spark plug 107, similar to the spark plug 104 (FIG. 8), the head portion 3H is formed of the insulating portion 3*i*, and the flange portion 3F is formed of the insulating portion 3*i* and the conductive portion 3*c*.

According to the spark plug 107, the capacitance C16 can be reduced by reducing the length of the conductive glass sealing layer 16, and the capacitance C7 is equal to the capacitance C16. Therefore, the capacitance C7 is low.

The present invention is not limited to the above-described embodiments, examples, and modifications described in this specification, and may be embodied in various forms without departing from the gist thereof. For example, the technical features of the embodiments, examples and modifications corresponding to the technical features according to the aspects described in the Summary of Invention section may be replaced or combined as appropriate to solve some or all of the above-described problems or obtain some or all of the above-described effects. The technical features may also be omitted as appropriate unless they are described as essential in this specification. For example, the following configurations may be employed.

The material of the conductive glass sealing layer 16 may contain a conductive material other than copper powder and glass powder other than calcium borosilicate glass powder. For example, carbon black or graphite powder may be used as the conductive material.

The coefficient of thermal expansion of the conductive material may be lower than that of the resistor 15. In this case, the coefficient of thermal expansion of the insulating material may be a value that is higher than the coefficient of thermal expansion of the conductive material and lower than the coefficient of thermal expansion of the resistor 15 as a value between the coefficient of thermal expansion of the conductive material and the coefficient of thermal expansion of the resistor 15.

It is not necessary that the insulating portion 3*i* and the conductive portion 3*c* be joined together by fitting a projection formed on one of the insulating portion 3*i* and the conductive portion 3*c* into a recess formed in the other of the insulating portion 3*i* and the conductive portion 3*c*. For example, the insulating portion 3*i* and the conductive portion 3*c* may both have recesses formed therein, and be joined together by using a rod-shaped member that can be fitted in the recesses. The rod-shaped member may be made of, for example, an insulating material that is the same as the material of the insulating portion 3*i*, another insulating material, or a material that is the same as the material of the conductive portion 3*c*. Alternatively, a projection and a recess may be provided and joined together by using an adhesive. Alternatively, the insulating portion and the conductive portion may have flat joining surfaces and be joined together by using an adhesive.

REFERENCE SIGNS LIST

1 . . . metal shell,
2 . . . insulator,
3 . . . center electrode,
3E . . . flange portion,
3H . . . head portion,
3L . . . leg portion,
3*c* . . . conductive portion,
3*cd* . . . recess,
3*ct* . . . projection,
3*i* . . . insulating portion,
3*id* . . . recess,
3*it* . . . projection,
3*p* . . . protruding portion,
4 . . . ground electrode,
5 . . . threaded portion,
6 . . . axial hole,
6*n* . . . small-diameter portion,
6*s* . . . step portion,
6*w* . . . large-diameter portion,
13 . . . terminal,
15 . . . resistor,
16 . . . conductive glass sealing layer,
16*h* . . . imaginary line,
17 . . . terminal-side conductive glass sealing layer,
31 . . . firing end,
32 . . . front end portion,
101 . . . spark plug,
102 . . . spark plug,
103 . . . spark plug,
104 . . . spark plug,
105 . . . spark plug,
106 . . . spark plug,
107 . . . spark plug Having described the invention, the following is claimed:

1. A spark plug comprising:

a metal shell that has a substantially tubular shape and is provided with a ground electrode at a front end of the metal shell in an axial direction;

an insulator that has a tubular shape, the insulator extending through a rear end of the metal shell toward the front end of the metal shell in the axial direction, the insulator being held in the metal shell, the insulator having an axial hole provided therein, the axial hole including a small-diameter portion, a large-diameter portion, and a step portion provided therebetween, the small-diameter portion of the insulator being closer than the large-diameter portion of the insulator to the front end of the metal shell in the axial direction, the large-diameter portion of the insulator having a diameter in a radial direction that is greater than a diameter of the small-diameter portion of the insulator in the radial direction, a front end of the large-diameter portion of the insulator in the axial direction being connected to a back end of the small-diameter portion of the insulator in the axial direction by the step portion;

a resistor disposed in the large-diameter portion of the insulator;

a center electrode formed from a conductive part made of a conductive material and an insulating part having a rod-like shape and made of an insulating material, a rear end of the conductive part of the center electrode being joined to a front end of the insulating part of the center electrode in the axial direction, the center electrode including:

a flange portion that protrudes in the radial direction in the large-diameter portion of the insulator, the flange portion being in contact with the step portion of the insulator;

a leg portion that extends foreward in the axial direction from the flange portion of the center electrode and out from a front end of the insulator in the axial direction, the leg portion being disposed in the small-diameter portion of the insulator; and a head portion that is rearward of the flange portion of the center electrode in the axial direction, the head portion extending away from the leg portion of the center electrode in the axial direction; and a conductive sealing member that is disposed in the large-diameter portion of the insulator, the conductive sealing member electrically connecting the conductive part of the center electrode to the resistor, wherein the insulating part of the center electrode includes a protruding portion extending toward a rear end of the resistor in the axial direction, the protruding portion being positioned rearward of the conductive sealing member in the axial direction, and wherein the protruding portion of the insulating part of the center electrode is embedded in the resistor.

2. The spark plug according to claim 1, wherein the conductive part of the center electrode is separated from the resistor by the insulating part of the center electrode and the conductive sealing member.

3. The spark plug according to claim 1, wherein the conductive part of the center electrode includes a recess in the rear end thereof in the axial direction, the recess extending toward a front end of the center electrode in the axial direction, wherein the insulating part includes a projection at the front end thereof in the axial direction, the projection projecting toward the front end of the center electrode in the axial direction, and wherein the projection is fitted in the recess.

4. The spark plug according to claim 1, wherein the conductive part of the center electrode includes a projection at the rear end thereof in the axial direction, the projection projecting away from a front end of the center electrode in the axial direction, wherein the insulating part of the center electrode includes a recess in the front end thereof in the axial direction, the recess extending away from the front end of the center electrode in the axial direction, and wherein the projection is fitted in the recess.

5. The spark plug according to claim 1, wherein a coefficient of thermal expansion of the insulating material is between a coefficient of thermal expansion of the conductive material and a coefficient of thermal expansion of the resistor.

6. The spark plug according to claim 1, wherein a rear area of the conductive part of the center electrode in the axial direction is in contact with an inner side of the conductive sealing material extending in the radial direction, the rear area of the conductive part of the center electrode in the axial direction being foreward in the axial direction of a rear end of the conductive sealing material.

* * * * *